US007896170B2

(12) United States Patent
Bjerkreim et al.

(10) Patent No.: US 7,896,170 B2
(45) Date of Patent: Mar. 1, 2011

(54) FLOW DIVIDER AND SEPARATION SYSTEM

(75) Inventors: Bernt Bjerkreim, Vestby (NO); Karl Olav Haram, Oslo (NO); Per Salater, Oslo (NO)

(73) Assignee: Statoil ASA, Stavanger (NO)

( * ) Notice: Subject to any disclaimer, the term of this patent is extended or adjusted under 35 U.S.C. 154(b) by 45 days.

(21) Appl. No.: 12/084,792

(22) PCT Filed: Nov. 10, 2006

(86) PCT No.: PCT/NO2006/000408

§ 371 (c)(1),
(2), (4) Date: Oct. 30, 2008

(87) PCT Pub. No.: WO2007/055590

PCT Pub. Date: May 18, 2007

(65) Prior Publication Data

US 2009/0159528 A1 Jun. 25, 2009

(30) Foreign Application Priority Data

Nov. 11, 2005 (NO) ..... 20055356

(51) Int. Cl.
*B01D 17/02* (2006.01)
*B01D 19/00* (2006.01)
*B01D 47/00* (2006.01)

(52) U.S. Cl. ..... 210/532.1; 210/539; 210/540; 166/75.12; 96/182; 96/206; 96/263; 96/366

(58) Field of Classification Search ..... 210/519, 210/532.1, 538, 539, 540, 541; 166/75.12; 285/122.1, 124.1, 124.2, 130.1, 131.1, 133.11; 137/561 A, 18.01; 138/115; 96/182, 184, 206, 220, 263, 366
See application file for complete search history.

(56) References Cited

U.S. PATENT DOCUMENTS

| | | | | | |
|---|---|---|---|---|---|
| 794,015 | A | * | 7/1905 | Hostetler | 210/532.1 |
| 1,378,054 | A | * | 5/1921 | Pratt | 285/131.1 |
| 1,505,208 | A | * | 8/1924 | Larner | 285/133.11 |
| 1,778,326 | A | * | 10/1930 | Kutzer | 210/538 |
| 1,984,242 | A | * | 12/1934 | Trainer et al. | 285/131.1 |

(Continued)

FOREIGN PATENT DOCUMENTS

DE 199 44 189 4/2001

(Continued)

OTHER PUBLICATIONS

International Search Report mailed Feb. 22, 2007 for International Application No. PCT/NO2006/000408.

*Primary Examiner* — Christopher Upton
(74) *Attorney, Agent, or Firm* — Wenderoth, Lind & Ponack, L.L.P.

(57) ABSTRACT

The present invention relates to a flow divider promoting separation, the flow divider comprising an inlet, at least one dividing fin, and two or more outlets. According to the present invention a pipeline leading to the inlet is sufficiently long to promote at least a degree of separation of a fluid that is carried through the pipeline and that initially is mixed, the lighter constituents flowing through a top section of the pipeline, and the heavier constituents flowing through a bottom section of the pipeline, wherein the at least one dividing fin is/are arranged either vertically and/or horizontally in order to divide the flow into two or more smaller flow streams downstream of the flow divider.

6 Claims, 3 Drawing Sheets

U.S. PATENT DOCUMENTS

| | | | | |
|---|---|---|---|---|
| 2,467,547 | A * | 4/1949 | Birnbaum | 210/532.1 |
| 3,625,258 | A * | 12/1971 | Phelps | 138/115 |
| 4,705,114 | A | 11/1987 | Schroeder et al. | |
| 5,165,450 | A * | 11/1992 | Marrelli | 137/118.01 |
| 5,232,475 | A * | 8/1993 | Jepson | 96/204 |
| 5,248,218 | A * | 9/1993 | Belcher | 285/133.11 |
| 5,286,375 | A * | 2/1994 | Marrelli | 210/242.1 |
| 5,322,551 | A | 6/1994 | Payne | |
| 5,507,858 | A | 4/1996 | Jepson | |
| 5,582,271 | A * | 12/1996 | Mielo | 210/519 |
| 6,544,420 | B1 * | 4/2003 | Høydal et al. | 210/532.1 |
| 6,620,221 | B1 | 9/2003 | Lenzing et al. | |
| 6,929,035 | B2 * | 8/2005 | Debaisieux et al. | 138/115 |
| 6,983,852 | B2 * | 1/2006 | Hemstock et al. | 210/519 |
| 7,021,336 | B2 * | 4/2006 | Burrows et al. | 285/132.1 |
| 7,152,885 | B2 * | 12/2006 | Takamatsu et al. | 285/131.1 |
| 7,278,543 | B2 * | 10/2007 | Sagatun et al. | 210/519 |
| 2005/0150842 | A1 * | 7/2005 | Puik | 210/539 |

FOREIGN PATENT DOCUMENTS

| | | |
|---|---|---|
| RU | 2 042 427 | 8/1995 |
| RU | 2 045 982 | 10/1995 |
| RU | 2 098 714 | 12/1997 |
| RU | 2 107 159 | 3/1998 |
| RU | 2 149 672 | 5/2000 |
| RU | 19 771 | 10/2001 |
| RU | 2 207 449 | 6/2003 |
| RU | 2 234 358 | 8/2004 |
| RU | 2 241 519 | 12/2004 |
| RU | 46 835 | 7/2005 |
| RU | 2 340 384 | 8/2005 |

* cited by examiner

A-A

FLOW DIVIDER AND SEPARATION SYSTEM

BACKGROUND OF THE INVENTION

I. Field of the Invention

The present invention relates to a flow divider that promotes equal distribution between parallel trains and separation.

II. Description of the Related Art

Modern oil and gas production has increasingly relied on installations wherein the collection, separation, boosting, and transport of production fluids takes place. These process plants may comprise a wide range of equipment, such as the number of multi or single phase pumps and/or compressors, multi or single stage pumps or compressors, and/or other kinds of equipment that are arranged in parallel in order to transport and/or process the production fluids from the source to some remote location. This parallel configuration is referred to as parallel trains. Before the production fluids reach the parallel trains, the production fluids are collected into larger pipes that lead to the trains. Before the production fluids enter the boosting equipment, the flow of production fluids must be divided equally between the trains. If both pumps and compressors are used in parallel, the production fluid must typically be feed into separation equipment, heat exchangers etc. in order to separate the liquid phase and the gas phase. In this case the gas phase is fed into one or more compressors and the liquid phase is fed into one or more pumps, wherein the pressure of the gas and liquid phases are considerably increased before they are transported through pipelines to some remote location. Regardless if the separators are necessary or not, the flow of production fluids must be divided as evenly as possible before the flow reaches the boosting trains, in order to utilize the maximum rated power of the boosting trains and to ensure equal distribution of the inhibitors.

The conventional solution is to feed the collected production fluids into some sort of manifold, wherein the fluids are mixed and distributed into two or more parallel trains. However, this solution may result in an uneven and fluctuating distribution of the production fluids and possible inhibitors, and as a consequence the separation equipment, heat exchangers, pumps and especially compressors have to be dimensioned for sufficient capacity to deal with temporary fluctuations and peaks. This over-dimensioning of equipment results in increased costs and weight of the process plant, and by ensuring a more even and constant distribution of production fluids to the parallel trains would result in significant savings and improved distribution of inhibitors. Also, the violent mixing of the production fluid right before it enters the separation equipment results in longer dwell times in the separators and a need for larger separation equipment, these factors also add to the cost.

SUMMARY OF THE INVENTION

The present invention provides a flow divider that divides the fluid flow more evenly and with less mixing of the fluids than conventional solutions.

DETAILED DESCRIPTION OF THE INVENTION

Figure 1:
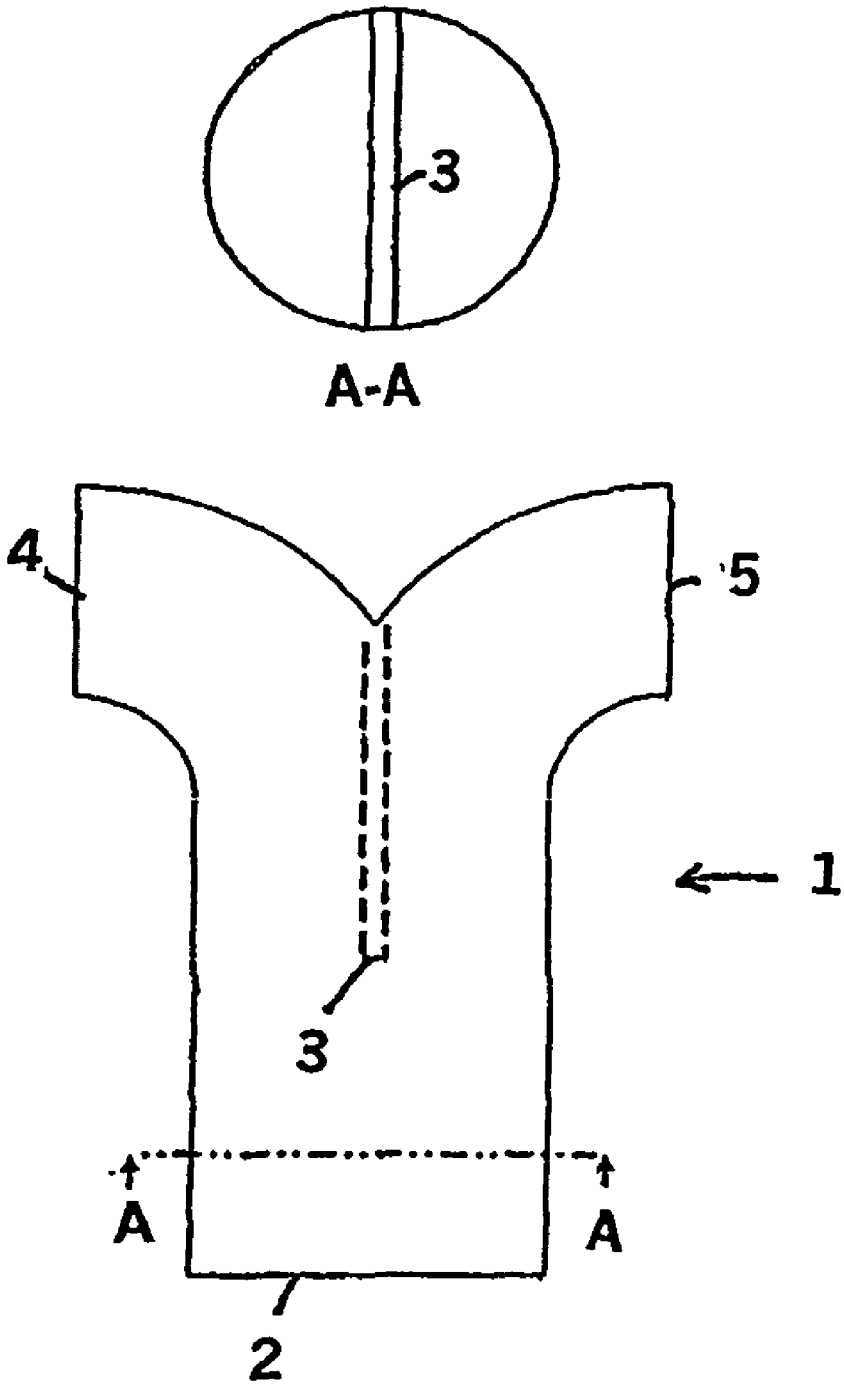
FIG. 1 shows one embodiment of the flow divider according to the present invention.
Figure 2:
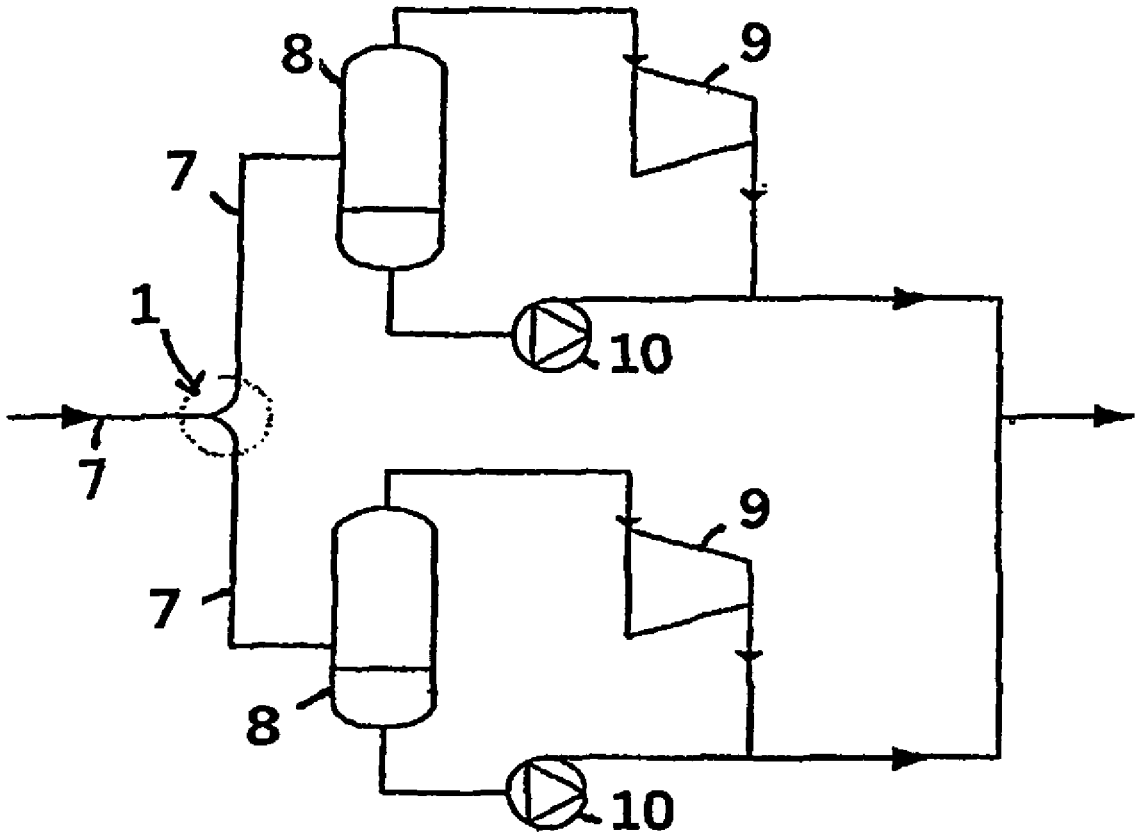
FIG. 2 shows the flow divider according to the present invention used in an application comprising two trains.

FIG. 1 shows a flow divider 1 according to the present invention, the flow divider 1 comprising an inlet 2, a dividing fin 3, and outlets 4, 5. The production fluid flow 6 entering the flow divider 1 through the inlet 2 has been lead through a production fluid collection and transport pipeline 7. Each of the outlets 4, 5 lead to downstream equipment. FIG. 2 shows an embodiment of the present invention where a scrubber 8 receives the divided fluid and separates it, before the gas is fed into a compressor 9 and the liquid is fed into a pump 10.

It is an important feature that the fluid is equally distributed over the cross section upstream of the flow divider, e.g. bending and restriction immediately upstream of the flow divider should be avoided.

According to one embodiment of the present invention, it may be of importance that the production fluid 6 carried in the production pipeline 7 to the flow divider 1 is stirred to the least degree possible. Tests have shown that a largely undisrupted flow of production fluid over longer stretches through a pipeline, results in a large degree of separation of the production fluid already in the pipeline. If this multi-phase flow is allowed to reach the separators 8 upstream of the boosting equipment 9, 10, without being disrupted by various restrictions along the pipeline 7 and pressure equalizing manifolds, the separators 8 will have an easier job completing the separation of the production fluid 6, thereby increasing the efficiency of the boosting process.

The flow divider 1 according to the present invention contributes significantly to this end. According to one preferred embodiment of the present invention, the dividing fin 3 is arranged vertically by the inlet 2 of the flow divider 1. The shape and design of the inlet 2, dividing fin 3, and outlets 4, 5, may be optimized in this regard to ensure that the layered and partly pre-separated production fluid 6 may continue calmly and undisrupted on its way to the separators 8 and boosting equipment 9, 10.

If the flow has to be divided into more than two separate streams, further flow dividers may be arranged further downstream of the first flow divider 1.

If the pipeline 7 collects production fluids from more than one well, as is often the case, this collection may take place somewhere upstream of the flow dividers, ensuring that the distance between the collection point and the flow divider 1 is sufficient to promote an even distribution over the cross section area of the inlet 2 and possibly a predetermined degree of separation or layering in the pipeline 7 before the layered production fluid enters the flow divider 1, separation equipment 8, or a pump or compressor. It is understood that several factors can help determine how long the pipeline 7 must be in order to promote an even distribution over the cross sectional area and possibly separation, i.e. the physical properties of the production fluids, flow rate, dimensions of the pipeline 7, and the degree of separation that is preferred.

Figure 3:
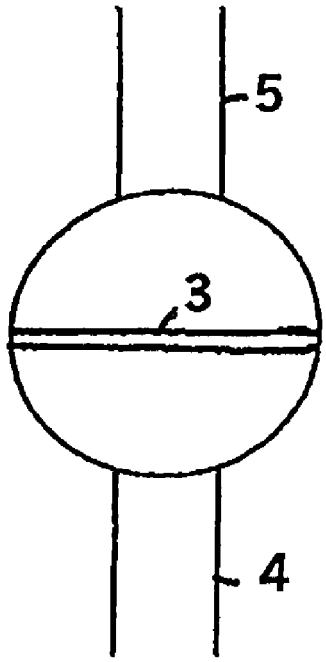
FIG. 3 shows another embodiment of the flow divider according to the present invention.
Figure 3:
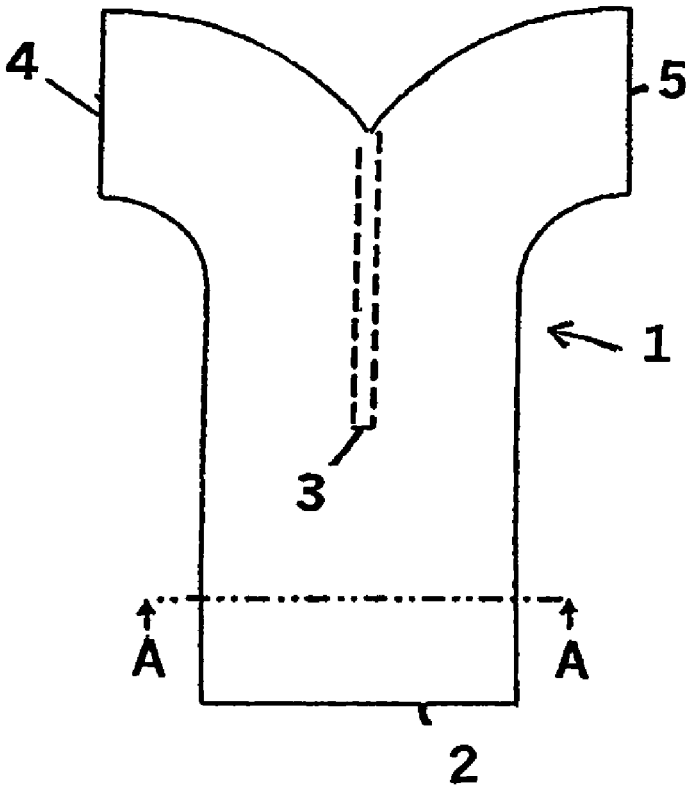

According to another preferred embodiment of the present invention, it is also possible to arrange the dividing fins 3 horizontally at one or more predetermined levels in the flow divider 1. This is shown in FIG. 3. Since the length and configuration of the pipeline 7 already has encouraged a certain degree of separation, the horizontal fins 3 may be arranged in, or at least very close to, the interface(s) between the various layers of the layered production fluid. The flow divider 1 will thereby in itself constitute a separator, wherein the fluids separated from, e.g. the top half of the pipeline, mainly comprise gas with perhaps some oil content, and the fluids separated from the bottom half mainly comprise oil and water. The two streams can be fed to two different separation equipments, one separating out the oil from the gas, the other separating the oil and water.

It is understood that the flow divider 1 according to the present invention also may be used for single phase flow. In a one phase flow, the fin may form a cross dividing the flow into four. However, the full potential of the present invention is reached when the separation of the production fluid flow in the pipeline 7 before the flow divider 1 is allowed to commence, and preferably has reached a stable layered multiphase flow with distinct interfaces between the various phases.

The invention claimed is:

1. A flow divider and separation system comprising:

a flow divider having an inlet, at least one dividing fin being arranged so as to be least one of vertically arranged and horizontally arranged in said flow divider to divide fluid flow into two or more flow streams downstream of said flow divider, and first and second outlets;

a production pipeline feeding said flow divider;

first and second scrubbers fed by a multi phase fluid from said first and second outlets of said flow divider, respectively;

first and second compressors fed by gasses separated from the multi phase fluid in said first and second scrubbers, respectively; and first and second pumps which receive liquid that has been separated from the multi phase fluid in said first and second scrubbers, respectively, wherein said flow divider and separation system is configured to promote equal distribution between parallel trains and separation for the multi phase fluid.

2. The flow divider and separation system according to claim 1, wherein said production pipeline is configured to be sufficiently long so as to promote a stable layered multiphase flow through the inlet.

3. The flow divider and separation system according to claim 2, wherein said at least one dividing fin is vertically arranged to divide the flow into two or more streams downstream of said flow divider.

4. Flow divider and separation system according to claim 2, wherein said flow divider is arranged to divide the flow into two or more stable layered multiphase flow streams downstream of said flow divider.

5. The flow divider and separation system according to claim 1, wherein said at least one dividing fin is vertically arranged to divide the flow into two or more streams downstream of said flow divider.

6. The flow divider and separation system according to claim 1, wherein said at least one dividing fin is horizontally arranged to separate the lighter constituents and the heavier constituents into divided and separated flow steams, and so as to direct the divided and separated flow streams through said first and second outlets to said first and second scrubbers.

* * * * *